US009301578B2

(12) United States Patent
Shinya et al.

(10) Patent No.: US 9,301,578 B2
(45) Date of Patent: Apr. 5, 2016

(54) BELT LENGTH ADJUSTER

(75) Inventors: Makoto Shinya, Higashiosaka (JP); Keiko Tsunashima, Higashiosaka (JP)

(73) Assignee: YAMAMOTO KOGAKU CO., LTD., Osaka (JP)

( * ) Notice: Subject to any disclaimer, the term of this patent is extended or adjusted under 35 U.S.C. 154(b) by 534 days.

(21) Appl. No.: 13/076,850

(22) Filed: Mar. 31, 2011

(65) Prior Publication Data

US 2011/0239416 A1 Oct. 6, 2011

(30) Foreign Application Priority Data

Mar. 31, 2010 (JP) ..... 2010-082070

(51) Int. Cl.
*F16B 2/02* (2006.01)
*A44B 11/04* (2006.01)

(52) U.S. Cl.
CPC ..... *A44B 11/04* (2013.01); *Y10T 24/44017* (2015.01)

(58) Field of Classification Search
CPC ..... A41F 1/00; A61F 9/027; A45C 12/30; A44B 11/04; Y10T 24/44017
USPC ..... 24/265 EC, 265 BC, 265 R, 32, 31 R, 34, 24/33 L, 170, 171, 196, 197, 198, 200
See application file for complete search history.

(56) References Cited

U.S. PATENT DOCUMENTS 48,135 A * 6/1865 Smith ..... 24/170
73,242 A * 1/1868 Gerard ..... 24/198
276,367 A * 4/1883 Dobbs ..... 24/200
459,362 A * 9/1891 Guilbert ..... 24/198
529,364 A * 11/1894 Claudy et al. ..... 24/32
634,014 A * 10/1899 Molloy ..... 24/198
722,375 A * 3/1903 Molloy ..... 24/198
747,060 A * 12/1903 Forman ..... 2/237

(Continued)

FOREIGN PATENT DOCUMENTS

CN 1903092 A 1/2007
FR 1320219 1/1963

(Continued)

OTHER PUBLICATIONS

European Search Report for EP 11160631.5 dated Apr. 5, 2012.

(Continued)

*Primary Examiner* — Robert J Sandy
*Assistant Examiner* — Rowland Do
(74) *Attorney, Agent, or Firm* — Heslin Rothenberg Farley & Mesiti P.C.

(57) ABSTRACT

A belt length adjuster includes a frame body with two outer frames and two connecting frames, and a support frame provided between the two outer frames and stretching to and between the two connecting frames. The support frame supports one end part of the belt member to be used with the belt length adjuster. Two inner frames are respectively provided between the support frame and the respective outer frames and stretching to and between the two connecting frames. The support frame and the respective inner frames provide first insertion spaces into which the one end part of the belt member is inserted, while the respective inner frames and the respective outer frames provide second insertion spaces into which the other side of the belt member is inserted. Furthermore the one end part of the belt member is easily attached to the frame body.

3 Claims, 17 Drawing Sheets

(56) References Cited

U.S. PATENT DOCUMENTS

| | | | | | |
|---|---|---|---|---|---|
| 820,710 | A * | 5/1906 | Ford | 24/184 |
| 871,981 | A * | 11/1907 | Blum | 24/198 |
| 1,209,075 | A * | 12/1916 | Thomas | 24/198 |
| 1,675,040 | A * | 6/1928 | Mix | 24/198 |
| 1,887,096 | A * | 11/1932 | Hodge | 24/196 |
| 1,887,614 | A * | 11/1932 | Alterson | 24/198 |
| 1,934,951 | A * | 11/1933 | Schaefer | 24/186 |
| 2,084,412 | A * | 6/1937 | Schaefer | 24/186 |
| 2,224,773 | A * | 12/1940 | Shaulson | 24/200 |
| 2,260,060 | A * | 10/1941 | Shaulson | 24/200 |
| 2,473,209 | A * | 6/1949 | Lombardi | 24/321 |
| 3,214,815 | A * | 11/1965 | Mathison | 24/200 |
| 3,222,688 | A * | 12/1965 | Rosenzweig | 2/323 |
| 3,327,361 | A * | 6/1967 | Mathison | 24/198 |
| 4,673,448 | A * | 6/1987 | Bartolini | 156/73.1 |
| 5,245,731 | A * | 9/1993 | Funathu | 24/200 |
| 5,590,443 | A * | 1/1997 | Fildan | 24/200 |
| D411,485 | S * | 6/1999 | Dreyfus et al. | D11/218 |
| 6,056,625 | A * | 5/2000 | Fildan | 450/86 |
| 6,684,463 | B1 * | 2/2004 | Yang | 24/197 |
| 6,994,606 | B2 * | 2/2006 | Li | 450/82 |
| 7,140,080 | B2 * | 11/2006 | Fildan et al. | 24/302 |
| 2002/0035767 | A1 * | 3/2002 | Sekanina | 24/170 |
| 2004/0226147 | A1 * | 11/2004 | Fildan et al. | 24/302 |
| 2005/0086772 | A1 * | 4/2005 | Yoshiguchi | 24/197 |
| 2006/0230585 | A1 * | 10/2006 | Fildan et al. | 24/200 |
| 2007/0022577 | A1 | 2/2007 | Funo | |
| 2008/0078069 | A1 * | 4/2008 | Pontaoe | 24/196 |
| 2009/0215360 | A1 | 8/2009 | Brideson | |

FOREIGN PATENT DOCUMENTS

| | | | |
|---|---|---|---|
| FR | 1320219 | A | 3/1963 |
| GB | 175007 | | 2/1922 |
| GB | 175007 | A | 2/1922 |
| JP | S35-004664 | Y | 3/1935 |
| JP | S16-016655 | Y | 11/1941 |
| JP | S18-009365 | Y | 8/1943 |
| JP | S49-115125 | U | 2/1948 |
| JP | S59-079006 | U | 5/1984 |
| JP | S60-020710 | U | 2/1985 |
| JP | 2007-054347 | | 3/2007 |
| WO | 2006086829 | A1 | 8/2006 |

OTHER PUBLICATIONS

Office Action issued for corresponding Japanese patent application No. 2010-082070 dated Oct. 1, 2013.

Office Action issued for corresponding Chinese patent application No. 201110079926.0 dated Dec. 10, 2013.

* cited by examiner

BELT LENGTH ADJUSTER

CROSS REFERENCE TO RELATED APPLECATIONS

This application claims priority of Japanese application No. 2010-082070 filed on Mar. 31, 2010, the entire disclosure of this application being hereby incorporated herein by reference.

FIELD OF THE INVENTION

The present invention relates to a belt length adjuster suitable for a wearing belt for goggles such as snow goggles, motor sport goggles, swimming goggles, safety protection goggles.

BACKGROUND OF THE INVENTION

An adjuster shown in FIG. 12 has been generally known as a belt length adjuster of this type. The adjuster includes a frame body 11, which has a substantially square shape with both side frames 11*a* and 11*a* and both connecting frames thereof 11*b* and 11*b*, and a support frame 12 for belt provided at a substantially central part of the inside of the frame body 11. An insertion space S is formed in both sides of the support frame 12, and a serrations or knurls 13 for slip prevention are provided on an inner side of each of both side frames 11*a* and 11*a* as desired.

The above-described belt length adjuster is used as shown in FIGS. 13 to 15. One end part of a belt B for goggles and the like is attached on the support frame 12, and the other end side of the belt B, which is folded back, is inserted upward into one of the insertion spaces S on both sides of the support frame 12, and, straddling the support frame 12, inserted downward into the other of the insertion spaces S and drawn out therefrom. Thus, shifting the position of the adjuster with regard to the belt B and changing the position where the belt is folded back enable adjustment of the length of the belt in use with the adjuster as stated above.

Another example of a known adjuster of the belt length is described in Japanese Patent Application, Laid-Open No. 2007-54347. As shown in FIG. 16, this adjuster has a frame body 21 having a substantially square inside space S and a slide body 22. The frame body 21 has opposing slide-contact frame parts 21*a* and 21*a* and opposing support frame parts 21*b* and 21*b*, these frames define the space S. The slide body 22 is loosely fixed to the support frame parts 21*b* and 21*b* in the inside of the frame body 21, and, supporting one end part of the belt 4, slidable toward either of the slide-contact frame parts 21*a* and 21*a*. One of the slide-contact frame parts 21*a* and 21*a* is provided with an exterior member 23 for slip prevention.

The foregoing belt length adjuster is used as shown in FIG. 17. One end part of the belt B is supported by the slide body 22, while the other end side is folded back, then inserted successively into the spaces S which are formed between the slide body 22 and each of the slide-contact frame parts 21*a* and 21*a*. Away from one of the slide-contact frame parts which stands in the side of the other end side of the inserted belt B, the slide body is slid toward the other of the slide-contact frame parts 21*a*. Thus the belt B is held between the slide body 22 and the other of the slide-contact frame parts 21*a* where the belt B can be fixed and engaged with respect to the frame body 21. On the other hand, releasing this holding engagement of the belt B therebetween enables the release of the fixed belt from the frame body 21, so that the adjustment of the belt length is achieved.

The above-described conventional belt length adjuster shown in FIG. 12 has a problem. Since a lower surface of the other end side of the belt B inserted into the insertion spaces S on both sides of the support frame 12 directly lies on top of and in contact with an upper surface of the one end part of the belt B attached to the support frame 12, and the contact area therebetween is large, which makes frictional resistance very large and makes it difficult to move the position of the adjuster and therefore to adjust the length of the belt.

The foregoing conventional belt length adjuster shown in FIG. 16 has another problem. One of the slide-contact frame parts 21*a* is provided with the exterior member 23 for slip prevention. Since the exterior member 23 is a separate member from the frame body 21, and needs to be annually wound around the slide-contact frame part 21*a*, the manufacture thereof is difficult and the manufacturing cost is high. Further, this belt length adjuster has a further problem. While the slide body 22 is provided to facilitate shifting the position of the adjuster, since the slide body 22 needs to be slid for shifting the position of the adjuster, such sliding is cumbersome and the adjustment of the belt length cannot be performed instantly.

Moreover, both of the above-described conventional belt length adjusters have a still further problem. When attaching one end part of the belt B to the support frame 12 of the frame body 11 or the slide body 22 of the frame body 21, it is necessary to insert the one end part of the belt B into the space S, wind it in a loop shape around the support frame 12 or the slide body 22, and sew the wound end to the belt body B, which requires cumbersome steps and is very inconvenient.

It is hence an object of the present invention to solve the above conventional problems, and to provide a belt length adjuster which enables easy and instant adjustment of the length of the belt, and moreover which is easily manufactured without a high manufacturing cost.

It is a further object of the present invention to provide the belt length adjuster which enables a simple attachment of one end part of the belt member to the frame body, thereby extremely easy attachment is achieved.

SUMMARY OF THE INVENTION

A belt length adjuster of the present invention includes a frame body with two outer frames and two connecting frames, and a support frame provided between the two outer frames stretching to and between the two connecting frames. The support frame supports one end part of a belt member to be used with the belt length adjuster. Two inner frames are respectively provided between the support frame and the respective outer frames and stretching to and between the two connecting frames. The support frame and the respective inner frames provide two first insertion spaces therebetween into which the one end part of the belt member is inserted, while the respective inner frames and the respective outer frames provide two second insertion spaces therebetween into which the other side of the belt member is inserted.

In the belt length adjuster of the present invention, both of the inner frames respectively protrude outwardly more than the support frame does.

Further, in the belt length adjuster of the present invention, width of each of the second insertion spaces is larger than width of the each first insertion spaces.

Also, in the belt length adjuster of the present invention, the frame body is formed to curve in an outwardly convex arc shape in cross section as a whole.

Further, in the belt length adjuster of the present invention, the support frame may be divided into two divided parts at a substantially central part thereof, thereby an insertion opening for the belt member is provided between the two divided parts.

And on a tip end of each of the divided parts of the support frame is provided a slip-out prevention part.

With the structure as briefly described above, the belt length adjuster of the present invention facilitates adjustment of the length of the belt member, such adjustment of belt length may be done instantly, the manufacturing thereof is easy, and the manufacturing cost is lowered. And furthermore, attachment of one end part of the belt member to the frame is simplified and such attachment can be extremely easy.

DETAILED DESCRIPTION OF THE PREFERRED EMBODIMENTS

Hereafter, embodiments for carrying out a belt length adjuster of the present invention will be described in detail in conjunction with the drawings.

Figure 1:
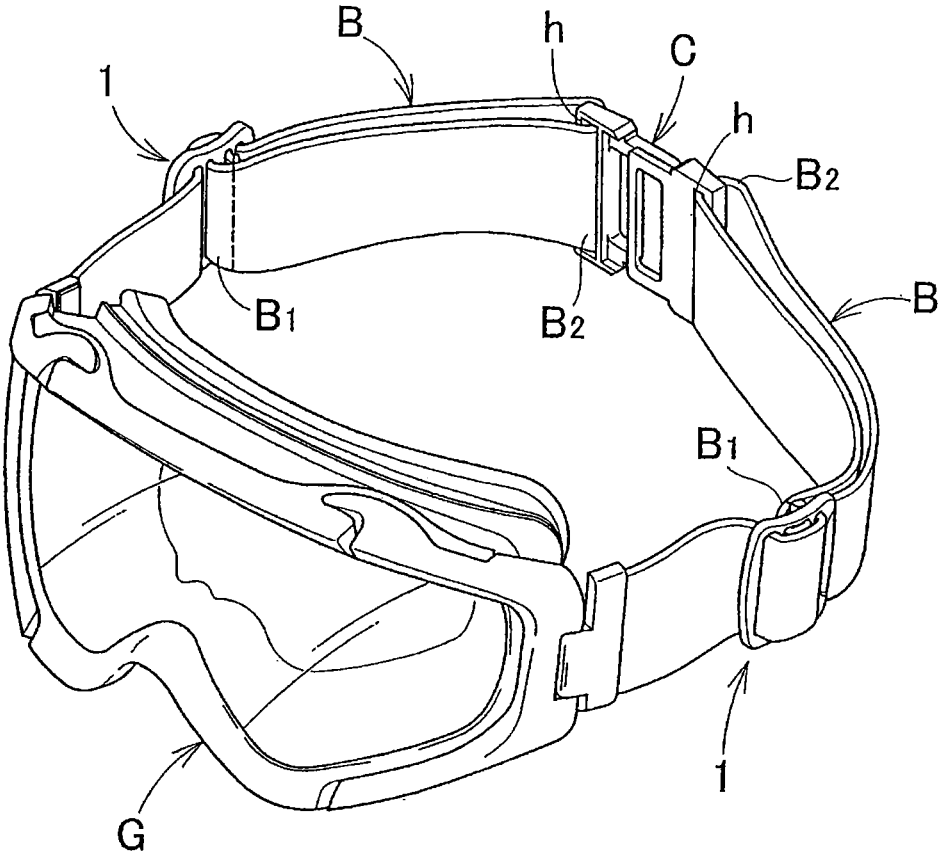
FIG. 1 is a perspective view of goggles having a wearing belt with a belt length adjuster of the present invention.
Figure 2:
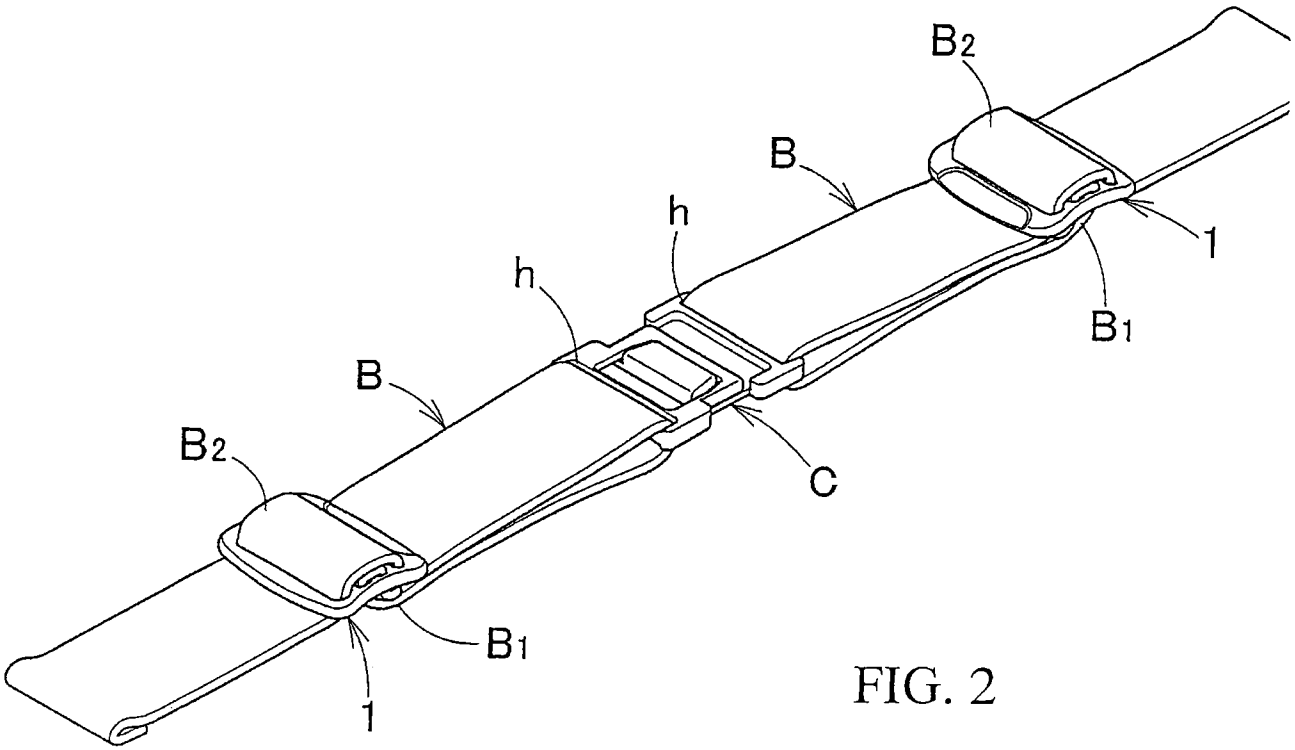
FIG. 2 a perspective view to show the state in which the belt length adjuster of the present invention is used with a wearing belt for goggles.

The belt length adjuster of the present invention is devised to be used with a wearing belt for goggles G and the like as shown in FIGS. 1 and 2, and enables adjustment of the length of the belt used therewith.

The wearing belt includes a pair of belt members B each of which has one end part B1 and the other end side B2. The one end part B1 of each belt member is supported by a belt length adjuster of the present invention. The other end side B2 of each belt member is inserted into a through hole h of a connector C. Each of the belt members is folded back at the through hole h and then inserted through the belt length adjuster of the present invention, drawn out therefrom, and connected to one side end of the goggles G. Both side ends of the goggles receive the other end sides B2 of the pair of the belt members B, respectively.

Figure 3:
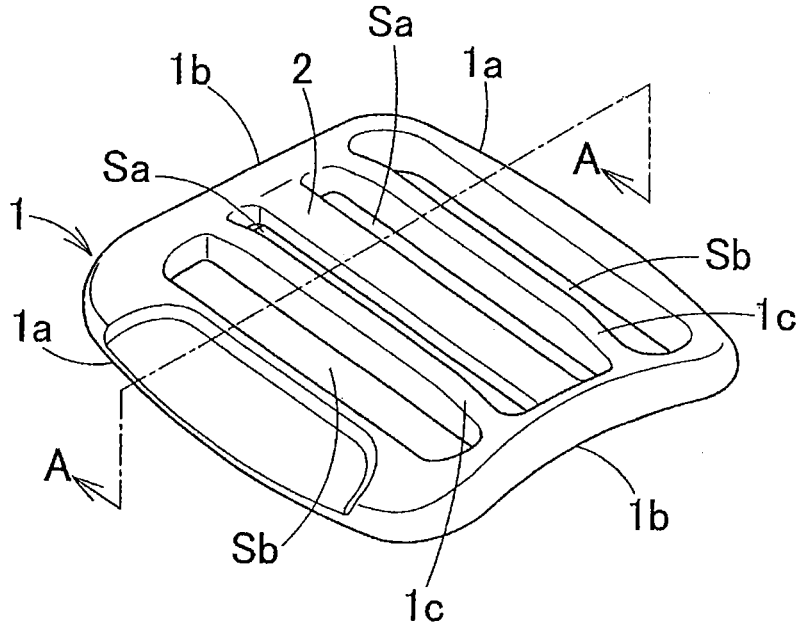
FIG. 3 is a perspective view of an embodiment of the belt length adjuster of the present invention.

As shown in FIG. 3, the belt length adjuster of the present invention includes a frame body 1 having a substantially square shape with both side outer frames (two outer frames) 1*a* and 1*a* and both side connecting frames (two connecting frames) 1*b* and 1*b*. The frames 1*a*, 1*a*, 1*b* and 1*b* define the square shape. The frame body 1 is made of a synthetic resin as one body. Inside of the frame body 1, a support frame 2 for supporting one end part B1 of the belt member B is provided between both of the outer frames 1*a* and 1*a*, and stretches to and between both of the connecting frames 1*b* and 1*b*. Between the support frame 2 and the respective outer frames 1*a* and 1*a*, inner frames 1*c* and 1*c* are provided, which respectively stretch to and between both the connecting frames 1*b* and 1*b*.

Moreover, the frame body 1 has two insertion spaces Sa and Sa (first insertion spaces) for respectively receiving the one end parts B1 of the pair of belt members B between the support frame 2 and the respective inner frames 1*c* and 1*c*, and two insertion spaces Sb and Sb (second insertion spaces) for respectively receiving the other end sides B2 of the pair of belt member B between the respective outer frames 1*a* and 1*a* and the respective inner frames 1*c* and 1*c*.

Figure 4:
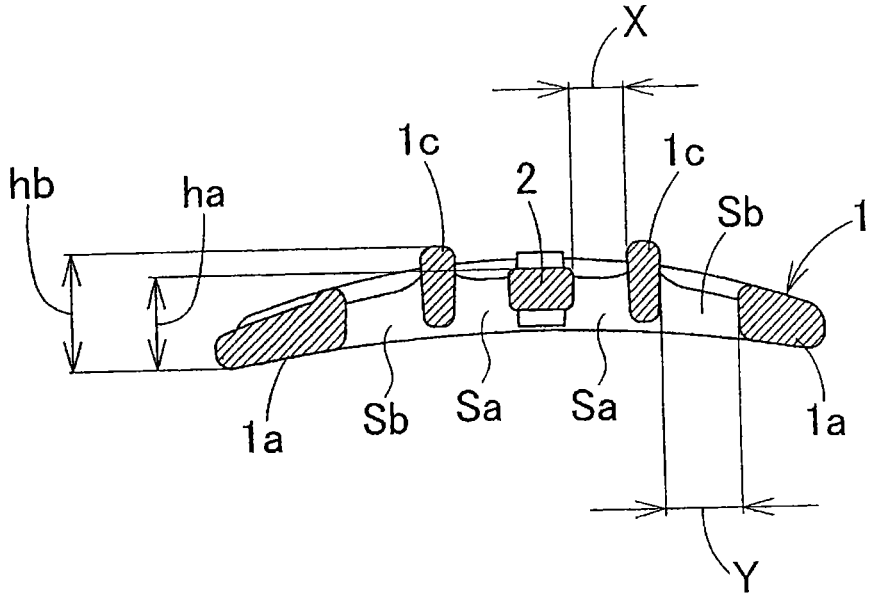
FIG. 4 is a sectional view of the belt length adjuster of the present invention taken along a line A-A in FIG. 3.
Figure 5:
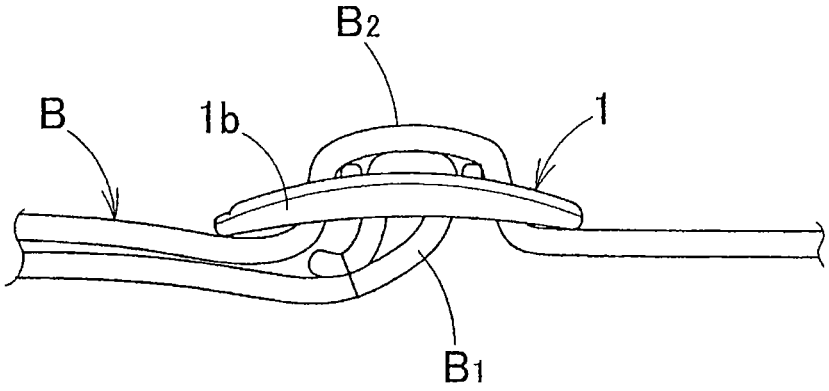
FIG. 5 is a side view to show the state in which the belt length adjuster of the present invention in FIG. 3 is used with the goggle wearing belt.
Figure 6:
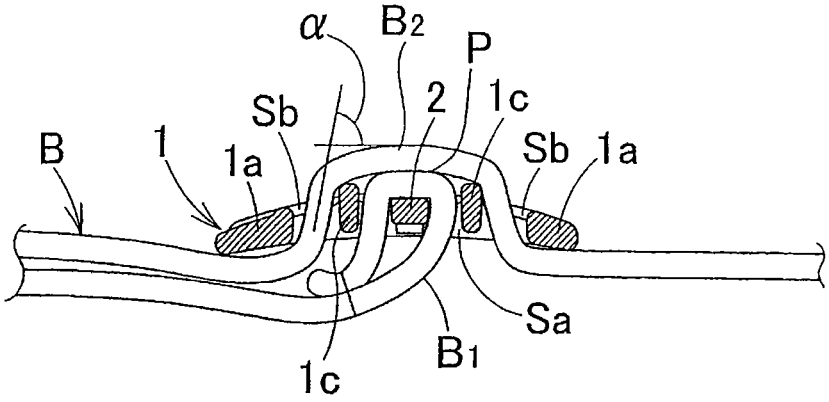
FIG. 6 is a sectional view to show the state in which the belt length adjuster of the present invention in FIG. 3 is used with the goggle wearing belt.

As clearly shown in FIGS. 4 to 6, in the belt length adjuster of the present invention, the height ha of the support frame 2 is lower than the height hb of each of the inner frames 1*c* and 1*c*, such that the respective inner frames 1*c* and 1*c* protrude outwardly more than the support frame 2 does. In this case, both of the inner frames 1*c* and 1*c* may partly protrude outwardly more than the support frame 2 does, but it is more preferable that they as a whole protrude more because the frictional resistance to be described later is reduced well balanced on the whole. It is noted that the difference between the height ha of the support frame 2 and the height hb of each of the inner frames 1*c* and 1*c* may be the same as or smaller than the thickness of each of the belt members B.

With this structure, the other end side B2 of each belt member B inserted into the insertion spaces Sb and Sb is raised by the inner frames 1*c* and 1*c*. On the other hand the one end side B1 of each belt member B is attached on the support frame 2 in the fashion that the one end part B1 is inserted into the insertion spaces Sa and Sa, wound around the support frame 2, and the wound end part is sewed to the belt member B. A lower surface of the other end side B2 and an upper surface of the one end part B1 of each belt member B contact with each other at the contacting area P. However, the other end side B2 of each belt member B inserted into the insertion spaces Sb and Sb is raised by the inner frames 1*c* and 1*c*, and the frictional resistance of the contacting area P between the upper surface of one end part B1 and the lower surface of the other end side B2 is reduced. Further, the lower surface of the other end side B2 of the belt member B slides being in contact with the portion ranging from the upper surface to a side surface of each of the inner frames 1*c* and 1*c*, which facilitates easy shift of the position of the belt length adjuster and thus easy adjustment of the length of the belt.

Figure 7:
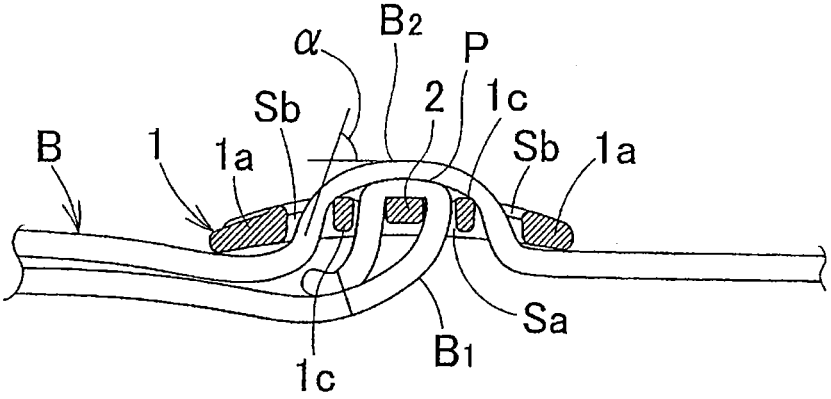
FIG. 7 is a sectional view to show the state in which another embodiment of the belt length adjuster of the present invention is used with a wearing belt for goggles.

As shown in FIG. 7, the height ha of the support frame 2 may be the same as the height hb of each of both inner frames 1*c* and 1*c*, and, in other words, the sizes of the outward protrusions of the support frame 2 and the respective inner frames 1*c* and 1*c* may be all the same. In this case, even if the frictional resistance of the contacting area P between the lower surface of the other end side B2 and the upper surface of the one end part B1 of the belt member B is not much reduced, since the lower surface of the other end side B2 of the belt member B slides being in contact with the portion ranging from the upper surface to the side surface of each of the inner frames 1*c* and 1*c*, shifting the position of the belt length adjuster is still easy and thus adjustment of the length of the belt is likewise easy.

Further, as shown in FIGS. 4 to 7, in the belt length adjuster of the present invention, the width Y of the insertion space Sb is larger than the width X of the insertion space Sa. The difference between the width X of the insertion space Sa and the width Y of the insertion space Sb is larger than the thickness of the belt member B. This structure reduces an insertion angle $\alpha$ of the belt member B with respect to the insertion spaces Sb and Sb respectively. Thus, the lower surface of the other end side B2 of the belt member B slides more easily being in contact with the portion ranging from the upper surface to the side surface of each of the inner frames 1*c* and 1*c*. As a result, shifting the position of the belt length adjuster becomes easier and thus adjustment of the length of the belt becomes similarly easier.

Figure 8:
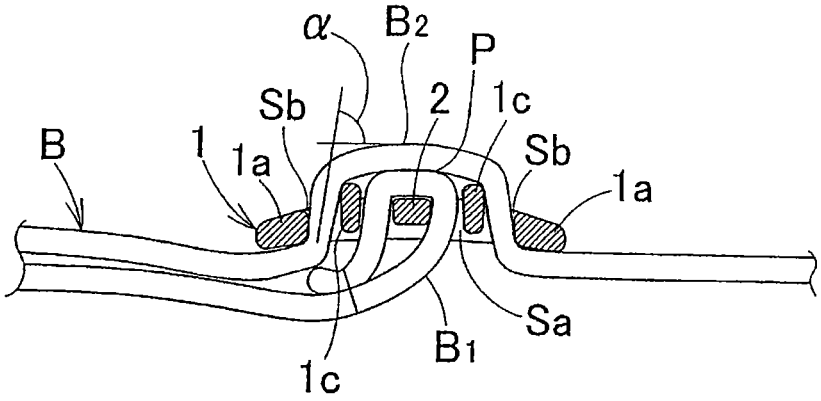
FIG. 8 is a sectional view to show the state in which a further embodiment of the belt length adjuster of the present invention is used with a wearing belt for goggles.

As shown in FIG. 8, the width X of the insertion space Sa may be equal to the width Y of the insertion space Sb. In this case, however, since the insertion angle $\alpha$ of the belt B with respect to the respective insertion spaces Sb and Sb becomes larger, and the lower surface of the other end side B2 of the belt member B will not be easier to slide on and with respect to the portion ranging from the upper surface to the side surface of each of the inner frames 1*c* and 1*c*. But yet, in this structure, the lower surface of the other end side B2 of the belt member B slide easily on and in contact with that portion as stated above, and thus shifting the position of the belt length adjuster becomes easier and easy adjustment of the length of the belt is achieved.

Figure 9:
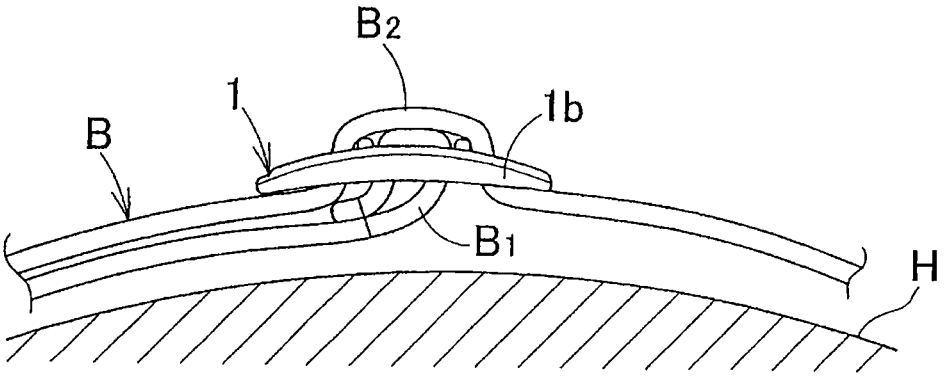
FIG. 9 is an explanatory view to show the state in which a goggle wearing belt having the belt length adjuster in FIG. 3 is brought closer to a head of a wearer.

Further, as shown in FIG. 9, as a whole, the frame body 1 is shaped to curve in a convex arc shape in the section (in other words, protruded outwardly) so that, when being used with a wearing belt of the goggles, the frame body 1 extends along a head part H of a wearer. With this structure, the frame body 1 is brought into close contact with a head H of a wearer and less likely to be displaced, thereby improving wearing comfortability.

Figure 10:
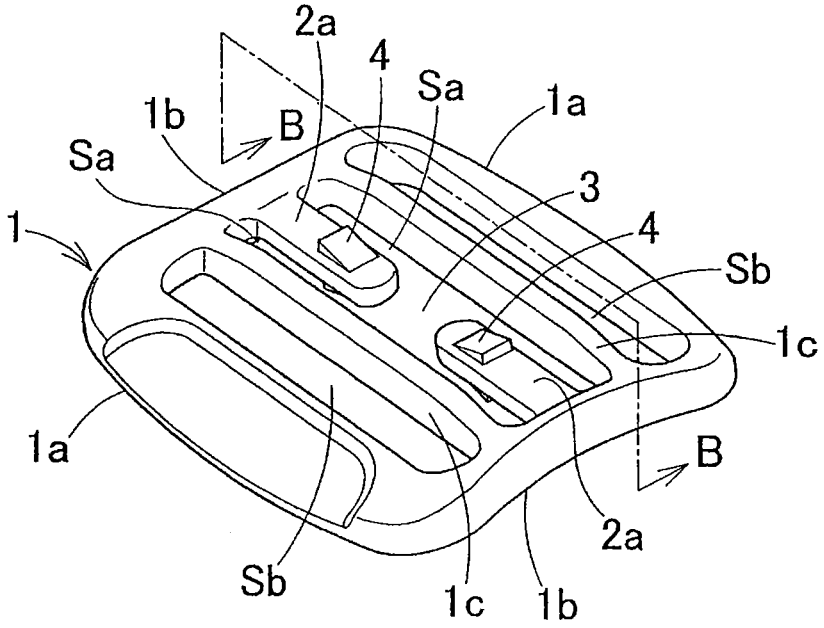
FIG. 10 is a perspective view of a further embodiment of the belt length adjuster of the present invention.
Figure 11:
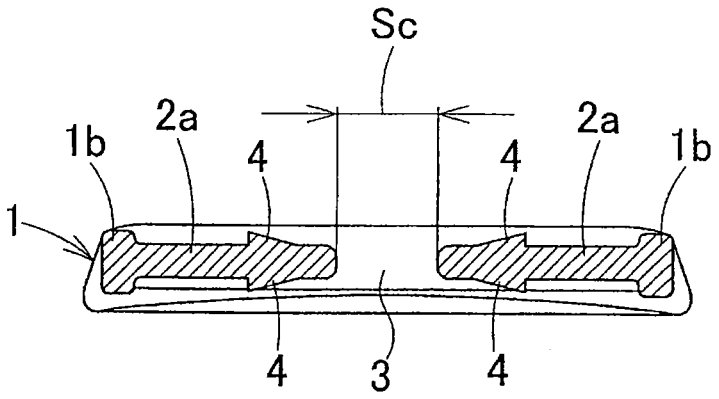
FIG. 11 is a sectional view of the belt length adjuster of the present invention taken along a line B-B in FIG. 10.
Figure 12:
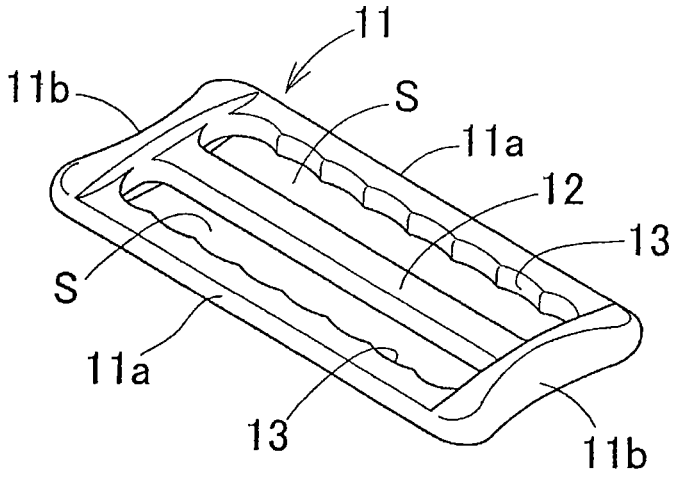
PRIOR ART FIG. 12
FIG. 12 is a perspective view of an example of a conventional belt length adjuster.
Figure 13:
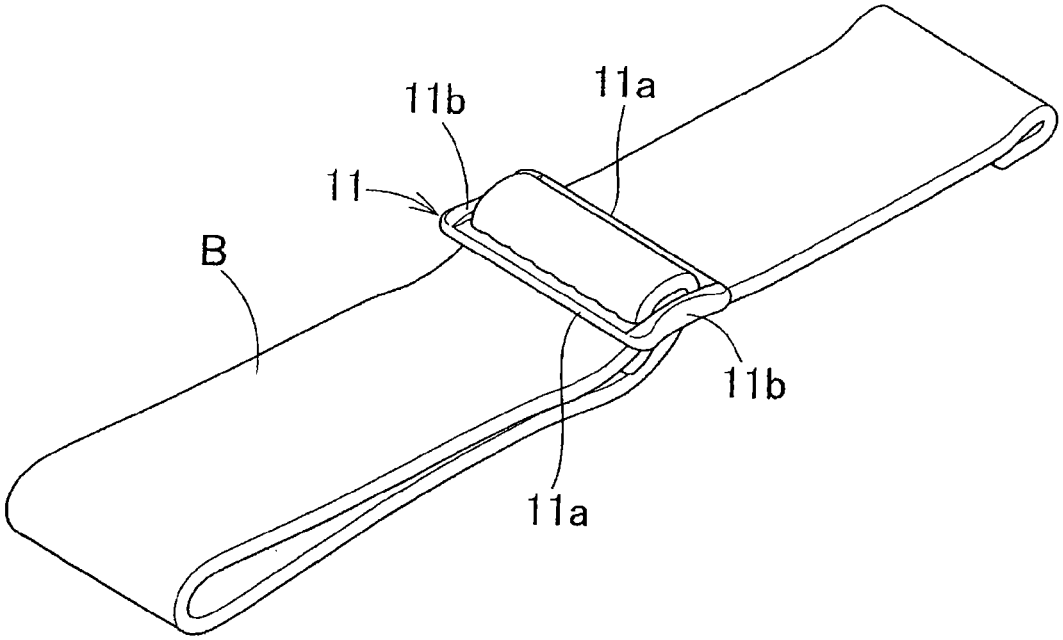
PRIOR ART FIG. 13
FIG. 13 is a perspective view to show the state in which the conventional belt length adjuster in FIG. 12 is used with a wearing belt.
Figure 14:
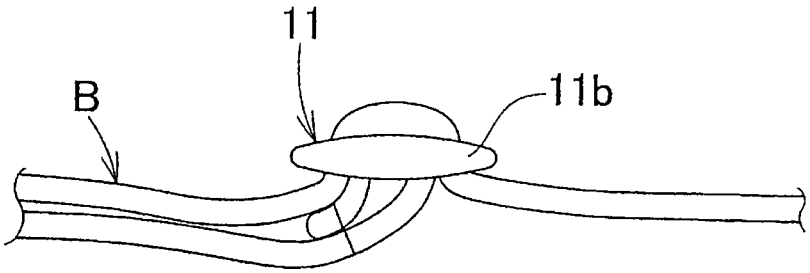
PRIOR ART FIG. 14
FIG. 14 is a side view to show the state in which the conventional belt length adjuster in FIG. 12 is used with the wearing belt.
Figure 15:
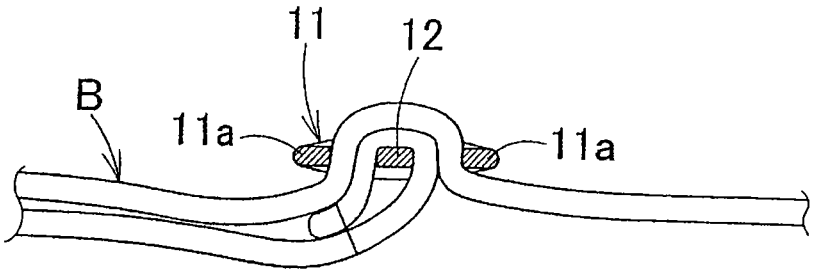
PRIOR ART FIG. 15
FIG. 15 is a sectional view to show the state in which the conventional belt length adjuster in FIG. 12 is used with the wearing belt.
Figure 16:
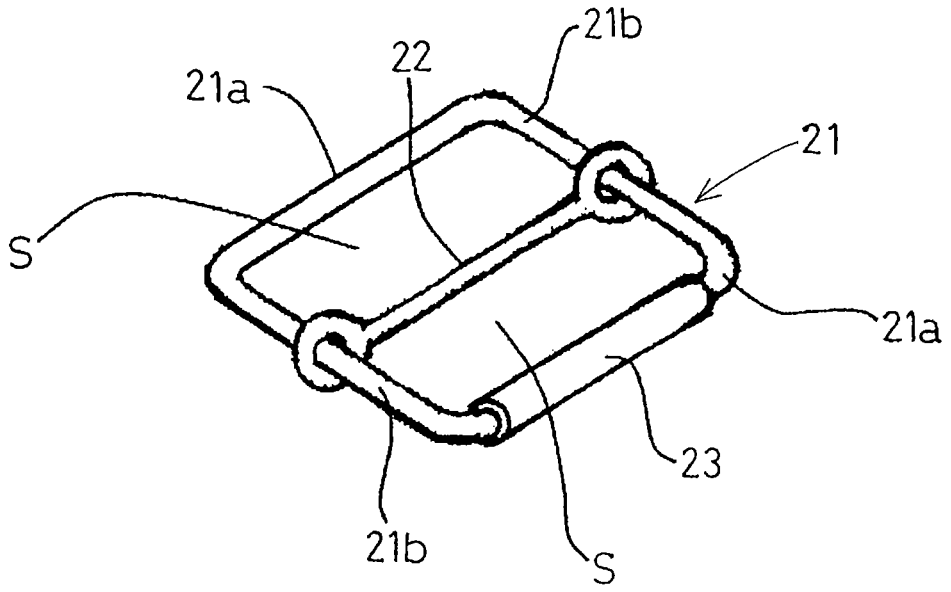
PRIOR ART FIG. 16
FIG. 16 is a perspective view of another example of a conventional belt length adjuster.
Figure 17:
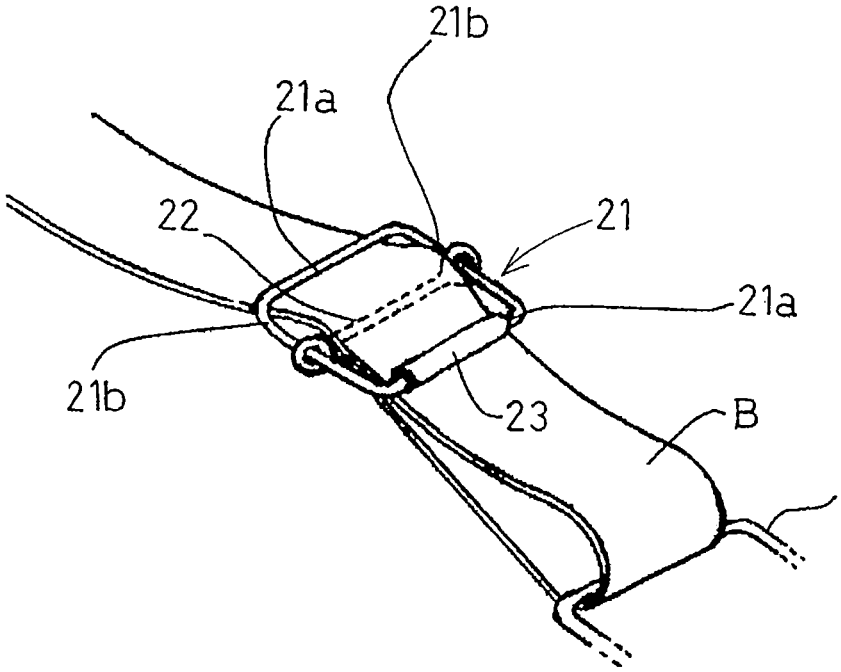
PRIOR ART FIG. 17
FIG. 17 is a perspective view to show the state in which the conventional belt length adjuster in FIG. 16 is used with a wearing belt.

Moreover, the belt length adjuster of the present invention is constructed as shown in FIGS. 10 and 11. The support frame 2 is divided into divided parts 2*a* and 2*a* at a substantially central part thereof, and an insertion opening 3 for the belt member B is provided between the divided parts 2*a* and 2*a*.

This structure eliminates cumbersome attachment of the one end part B1 on the support frame 2. Specifically, inserting the one end part B1 into the insertion spaces Sa and Sa, winding the one end part around the support frame 2, and sewing the wound end part to the belt member are eliminated. In this case, the one end part B1 of the belt member B needs to be provided with a loop portion (not shown) by sewing in advance. With this loop portion receiving the divided parts 2*a* and 2*a* therein in a gap Sc defined by the insertion opening 3, the one end part B1 is very easily attached to the support frame 2.

The size of the gap Sc of the insertion opening 3 is larger than the thickness of the belt member B, preferably 2 to 4 times the thickness of the belt member B, and ⅙ to ⅓ of the width of the belt member B. With this structure, the belt member B can be easily inserted into the insertion opening 3, while the belt member is less likely to slip out from the divided parts 2*a* and 2*a*.

Further, as shown in FIGS. 10 and 11, in the belt length adjuster of the present invention, a slip-out prevention part 4 for the belt member B is provided on the tip end of each divided part 2*a* of the support frame 2. This slip-out prevention part 4 is formed with a protruded triangular pole shape having a slope ascending from the tip end side of each divided part 2*a*, but not limitative thereto as long as it prevents the slip-out of the loop portion of the belt member B into which the divided parts 2*a* are inserted.

This structure can not only facilitate the insertion of the belt member into the insertion opening 3, but also prevent the belt member B from slipping out from the divided part 2*a*.

The belt length adjuster of the present invention as stated above facilitates shifting of the position of the adjuster with respect to the belt member, and easy and instant adjustment of the length of the belt.

Moreover, the belt length adjuster of the present invention needs no separate slip-out prevention member, and may be molded with a synthetic resin as one body. Therefore it can be simply manufactured with low manufacturing cost.

Further, in the belt length adjuster of the present invention, attachment of the one end part B1 of the belt member B to be adjusted is very simple and readily done.

What is claimed is:

1. A belt length adjuster for use with a belt member, the belt length adjuster comprising:

a frame body having a substantially square shape defined by two outer frames joined together at respective ends by two longitudinally extending connecting frames;

a support frame provided between the two outer frames and stretching to and between the two connecting frames;

two inner frames provided between the support frame and the respective two outer frames, the inner frames stretching to and between the connecting frames;

two first insertion spaces provided between the support frame and the respective inner frames;

two second insertion spaces provided between the respective inner frames and the respective outer frames; wherein the support frame is configured to support a first end part of a belt member, the two first insertion spaces are configured to receive the first end part of the belt member and the two second insertion spaces are configured to receive a second end part of the belt member;

both of the inner frames have a height higher than the support frame in a longitudinal mid section;

a width of each of the second insertion spaces through which the second end of the belt member passes is wider than a width of each of the first insertion spaces through which the first end of the belt member passes;

the frame body throughout a whole longitudinal extent is curved in a convex arc shape in longitudinal section;

the support frame is divided at a substantially central part into two divided parts each extending inwardly from a respective connecting frame, and an insertion opening for the belt member is provided between the two divided parts; and a slip-out prevention member extending in height from each of top and bottom surfaces of each divided part is provided on a tip end part of each of the divided parts of the support frame to prevent the belt member from slipping out from the divided parts.

2. The belt length adjuster according to claim 1, wherein the insertion opening is configured to have a size of 2to 4 times a thickness and ⅙ to ⅓ of a width of a belt to be received.

3. The belt length adjuster according to claim 1, wherein the slip-out prevention member has, in a laterally extending cross-sectional plane, a protruded triangular pole shape having a slope ascending from each of the top and bottom surfaces of a tip end side of each divided part toward the respective connecting frame.

* * * * *